US008905799B2

(12) United States Patent
Endo

(10) Patent No.: US 8,905,799 B2
(45) Date of Patent: Dec. 9, 2014

(54) PRESS BOND TERMINAL

(75) Inventor: Tatsuya Endo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 13/504,805

(22) PCT Filed: Oct. 25, 2010

(86) PCT No.: PCT/JP2010/068882

§ 371 (c)(1),
(2), (4) Date: Apr. 27, 2012

(87) PCT Pub. No.: WO2011/052549

PCT Pub. Date: May 5, 2011

(65) Prior Publication Data

US 2012/0208409 A1 Aug. 16, 2012

(30) Foreign Application Priority Data

Oct. 28, 2009 (JP) ..... 2009-247868

(51) Int. Cl.
*H01R 4/10* (2006.01)
*H01R 4/18* (2006.01)

(52) U.S. Cl.
CPC ..... *H01R 4/185* (2013.01)
USPC ..... 439/877; 439/442

(58) Field of Classification Search
CPC ..... H01R 4/185; H01R 12/68; H01R 12/69
USPC ..... 439/877
See application file for complete search history.

(56) References Cited

U.S. PATENT DOCUMENTS 2,854,648 A * 9/1958 Berg ..... 439/867
3,892,459 A * 7/1975 Dittmann et al. ..... 439/442

(Continued)

FOREIGN PATENT DOCUMENTS

CN 1255758 A 6/2000
JP 120079-1980 2/1954

(Continued)

OTHER PUBLICATIONS

International Search Report (PCT/ISA/210) issued on Nov. 22, 2010 in the International Patent Application No. PCT/JP2010/068882.

(Continued)

*Primary Examiner* — Hae Moon Hyeon
(74) *Attorney, Agent, or Firm* — Sughrue Mion, PLLC

(57) ABSTRACT

An object of the invention is to provide a press bond terminal capable of easily ensuring compatibility between electrical connection performance and mechanical connection performance in the case of connecting a terminal to an electric wire. In a press bond terminal (10) having a conductor press bond part (13) connected by being pressed and bonded to a distal end of a conductor (Wa) of an electric wire, the conductor press bond part (13) being formed in substantially a U-shaped cross section by a base plate (13A) and a pair of conductor crimp pieces (13B) which is extended upward from both right and left lateral edges of the base plate (13A) and is crimped so as to wrap the conductor (Wa) disposed on an inner surface of the base plate (13A), an inner surface of the base plate (13A) of the conductor press bond part (13) is provided with a projecting bar (22).

5 Claims, 3 Drawing Sheets

(56) References Cited

U.S. PATENT DOCUMENTS

| | | | | |
|---|---|---|---|---|
| 3,990,143 | A * | 11/1976 | Dittmann et al. | 29/865 |
| 4,669,798 | A * | 6/1987 | Daum et al. | 439/423 |
| 5,137,468 | A * | 8/1992 | Murakami | 439/422 |
| 6,200,162 | B1 | 3/2001 | Aoyama et al. | |
| 6,206,727 | B1 | 3/2001 | Aoyama et al. | |
| 6,210,223 | B1 | 4/2001 | Aoyama et al. | |
| 6,350,145 | B1 * | 2/2002 | Chen et al. | 439/422 |
| 6,450,831 | B2 * | 9/2002 | Aoyama et al. | 439/399 |
| 6,565,377 | B2 * | 5/2003 | Sawayanagi et al. | 439/422 |
| 7,210,958 | B1 * | 5/2007 | Jacques et al. | 439/421 |
| 7,462,062 | B2 * | 12/2008 | Kumakura | 439/422 |
| 7,867,014 | B2 * | 1/2011 | Kuwayama | 439/452 |
| 7,901,257 | B2 * | 3/2011 | Okamura et al. | 439/877 |
| 7,980,884 | B2 * | 7/2011 | Kondo et al. | 439/422 |
| 8,221,171 | B2 * | 7/2012 | Ono et al. | 439/877 |
| 2003/0096533 | A1 | 5/2003 | Kojima et al. | |
| 2009/0130923 | A1 * | 5/2009 | Kuwayama | 439/852 |
| 2010/0035485 | A1 | 2/2010 | Okamura et al. | |
| 2010/0105257 | A1 | 4/2010 | Kumakura et al. | |
| 2011/0003518 | A1 | 1/2011 | Ono et al. | |
| 2011/0009014 | A1 | 1/2011 | Ono et al. | |
| 2011/0073365 | A1 | 3/2011 | Kuwayama et al. | |
| 2012/0214361 | A1 * | 8/2012 | Endo | 439/882 |

FOREIGN PATENT DOCUMENTS

| | | | |
|---|---|---|---|
| JP | 2000164263 | A | 6/2000 |
| JP | 2006228759 | A | 8/2006 |
| JP | 2008305571 | A | 12/2008 |
| JP | 201049843 | A | 3/2010 |
| JP | 201080189 | A | 4/2010 |
| JP | 2010103012 | A | 5/2010 |
| JP | 2010140807 | A | 6/2010 |
| WO | 2009/064009 | A2 | 5/2009 |
| WO | 2009154108 | A1 | 12/2009 |
| WO | 2009154109 | A1 | 12/2009 |

OTHER PUBLICATIONS

Written Opinion (PCT/ISA/237) issued on Nov. 22, 2010 in the International Patent Application No. PCT/JP2010/068882.

Office Action dated Aug. 21, 2013, issued by the Japanese Patent Office in counterpart Japanese Application No. 2009-247868.

Office Action dated Jan. 16, 2014 issued by the State Intellectual Property Office of the People's Republic of China in counterpart Chinese Patent Application No. 201080049168.1.

Search Report dated Feb. 21, 2014 issued by the European Patent Office in counterpart European Patent Application No. 10826681.8.

Office Action dated Sep. 19, 2014 issued by the State Intellectual Property Office of the People's Republic of China in counterpart Chinese Patent Application No. 201080049168.1.

* cited by examiner (e)

PRESS BOND TERMINAL

TECHNICAL FIELD

The present invention relates to a press bond terminal of an open barrel type having a conductor press bond part with substantially a U-shaped cross section used in, for example, an electrical equipment system of an automobile.

BACKGROUND ART

FIG. 3 is a perspective view showing a configuration of a conventional press bond terminal described in Patent Reference 1.

This press bond terminal 100 includes an electrical connection part 101 connected to a terminal of the other connector side (not shown) in the front of a longitudinal direction (also a longitudinal direction of a conductor of an electric wire connected) of the terminal, and includes a conductor press bond part 110 crimped to the conductor in which the distal end of the electric wire (not shown) is exposed in the back of the electrical connection part 101, and further includes a coating crimp part 120 crimped to the portion having an insulating coating in the electric wire in the back of the conductor press bond part 110. Also, a first joining part 105 for joining the electrical connection part 101 to the conductor press bond part 110 is included between the electrical connection part 101 and the conductor press bond part 110, and a second joining part 106 for joining the conductor press bond part 110 to the coating crimp part 120 is included between the conductor press bond part 110 and the coating crimp part 120.

The conductor press bond part 110 is formed in substantially a U-shaped cross section by a base plate 111 and a pair of conductor crimp pieces 112, 112 which is extended upward from both right and left lateral edges of the base plate 111 and is crimped so as to wrap the conductor of the electric wire disposed on an inner surface of the base plate 111. Also, the coating crimp part 120 is formed in substantially a U-shaped cross section by a base plate 121 and a pair of coating crimp pieces 122, 122 which is extended upward from both right and left lateral edges of the base plate 121 and is crimped so as to wrap the electric wire (that is, the portion having the insulating coating) disposed on an inner surface of the base plate 121.

Also, both of the first joining part 105 and the second joining part 106 in the front and back of the conductor press bond part 110 are formed in substantially U-shaped cross sections by base plates 105A, 106A and low side plates 1058, 1068 upward erected from both right and left lateral edges of the base plates 105A, 106A.

Then, the portion ranging from a base plate (not shown) of the front electrical connection part 101 to the base plate of the backmost coating crimp part 120 (that is, the base plate 105A of the first joining part 105, the base plate 111 of the conductor press bond part 110, the base plate 106A of the second joining part 106 and the base plate 121 of the coating crimp part 120) is formed continuously in a shape of one band plate. Also, the front and back ends of the low side plate 105B of the first joining part 105 respectively continue with the back end of a side plate (numeral is omitted) of the electrical connection part 101 and each lower half part of the front end of the conductor crimp piece 112 of the conductor press bond part 110, and the front and back ends of the low side plate 106B of the second joining part 106 respectively continue with the back end of the conductor crimp piece 112 of the conductor press bond part 110 and each lower half part of the front end of the coating crimp piece 122 of the coating crimp part 120.

Also, an inner surface of the conductor press bond part 110 is provided with plural serrations 118 with a recessed groove shape extending in a direction orthogonal to the longitudinal direction (that is, the longitudinal direction of the terminal) of the conductor of the electric wire.

In the case of pressing and bonding the conductor press bond part 110 of this press bond terminal 100 to the conductor of the distal end of the electric wire, the press bond terminal 100 is placed on a placement surface (that is, an upper surface) of a lower mold (that is, an anvil) (not shown) and also, the conductor of the distal end of the electric wire is inserted between the conductor crimp pieces 112 of the conductor press bond part 110 and is placed on an upper surface of the base plate 111. Then, by downward moving an upper mold (that is, a crimper) relatively with respect to the lower mold, the distal end sides of the conductor crimp pieces 112 are gradually laid inward by a guide inclined surface of the upper mold.

Then, by further downward moving the upper mold (the crimper) relatively with respect to the lower mold, finally, the distal ends of the conductor crimp pieces 112 are rounded so as to be folded back to the conductor side by a curved surface ranging from the guide inclined surface of the upper mold to a chevron-shaped part of the center, and the distal ends of the conductor crimp pieces 112 are mutually bitten into the conductor while being rubbed together and thereby, the conductor crimp pieces 112 are crimped so as to wrap the conductor.

By the above operation, the conductor press bond part 110 of the press bond terminal 100 can be connected to the conductor of the electric wire by press bonding. In addition, similarly in the coating crimp part 120, using the lower mold and the upper mold, the coating crimp pieces 122 are gradually bent inward and are crimped to the portion having the insulating coating in the electric wire. This allows the press bond terminal 100 to be electrically and mechanically connected to the electric wire.

PRIOR ART REFERENCE

Patent Reference

Patent Reference 1: JP-A-2006-228759 (FIG. 1)

DISCLOSURE OF THE INVENTION

Problems that the Invention is to Solve

Incidentally, the case of the conventional press bond terminal described above has a problem of being difficult to do press bonding work since the range capable of ensuring compatibility between stable electrical connection performance and fastening strength (that is, mechanical connection performance) is narrow. For example, strong press bonding causes excessive press bonding and stabilizes the electrical connection performance, but a bite of the conductor crimp pieces may cause a break in a core wire to decrease the fastening strength. On the other hand, when the conductor crimp pieces are weakly crimped in order to avoid the excessive press bonding, this causes lack of the fastening strength or instability of the electrical connection performance.

In view of the circumstances described above, an object of the invention is to provide a press bond terminal capable of easily ensuring compatibility between electrical connection performance and mechanical connection performance in the case of connecting a terminal to an electric wire.

Means for Solving the Problems (1) In order to solve the problem described above, one aspect of the invention provides a press bond terminal having a conductor press bond part connected by being pressed and bonded to a distal end of a conductor of an electric wire, the conductor press bond part being formed in substantially a U-shaped cross section by a base plate and a pair of conductor crimp pieces which is extended upward from both right and left lateral edges of the base plate and is crimped so as to wrap the conductor disposed on an inner surface of the base plate, wherein an inner surface of the base plate of the conductor press bond part is provided with a projection.

(2) In the press bond terminal of (1) described above, the projection is preferably formed as a projecting bar continuous in a longitudinal direction of the conductor.

(3) In the press bond terminal of (1) described above, the projection is preferably formed as plural projections spaced in a longitudinal direction of the conductor.

Advantage of the Invention

According to the press bond terminal of (1) described above, the presence of the projection projecting to the side of the conductor of the electric wire in the conductor press bond part can increase internal stress of the conductor press bond part as compared with a press bond part with the same crimp height (C/H) having no projection. As a result, a grip force of the conductor press bond part on the conductor of the electric wire can be improved and also, misalignment between core wires of the conductor can be reduced and the range of compatibility between stable electrical contact and fastening strength can be expanded.

When the projection is formed as the projecting bar continuous in the longitudinal direction of the conductor as shown in the press bond terminal of (2) described above, the projection is present as the projecting bar rather than point-like presence, so that the internal stress can be increased over a long range in the front and back directions (that is, the longitudinal direction of the conductor) of the conductor press bond part, and the grip force can be improved more.

When the projection is formed as the plural projections spaced in the longitudinal direction of the conductor as shown in the press bond terminal of (3) described above, in conjunction with an increase in the internal stress of the conductor press bond part by the presence of the projection, an increase in a binding force of the conductor in a region sandwiched between the front and back projections strengthens action of reducing misalignment between core wires of the conductor, and a more stable electrical contact state can be maintained.

MODE FOR CARRYING OUT THE INVENTION

Embodiments of the invention will hereinafter be described using the drawings.

In addition, in a press bond terminal of the invention, the side connected to the other connector is set at the front and the side connected to an electric wire is set at the back.

First Embodiment

Figure 1A:
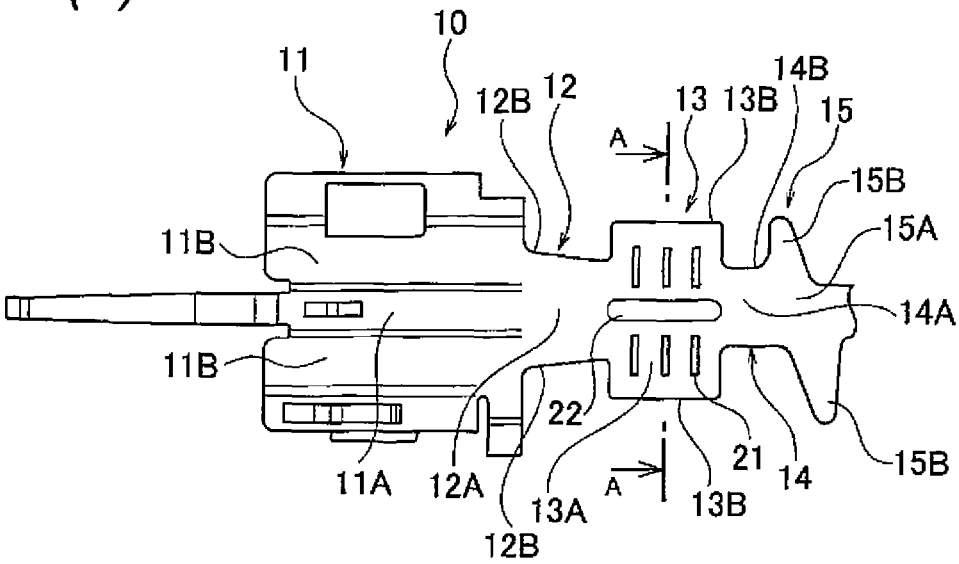
FIGS. 1(*a*) to 1(*c*) are configuration views of a press bond terminal of a first embodiment of the invention, and FIG. 1(*a*) is a developed plan view of the press bond terminal, and FIG. 1(*b*) is a sectional view taken on arrow line A-A of FIG. 1(*a*), and FIG. 1(*c*) is a transverse sectional view showing a state after a conductor press bond part of the press bond terminal is pressed and bonded.
Figure 1B:
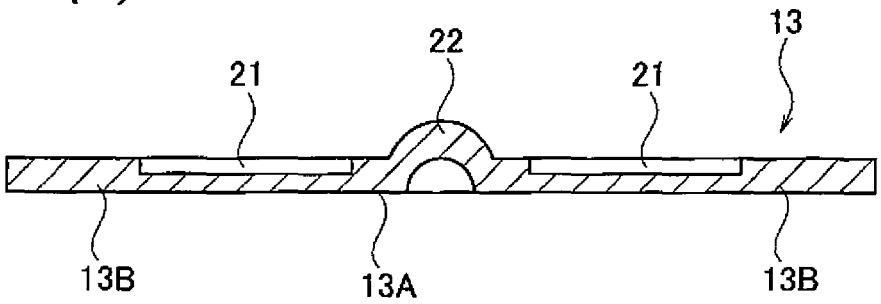
Figure 1C:
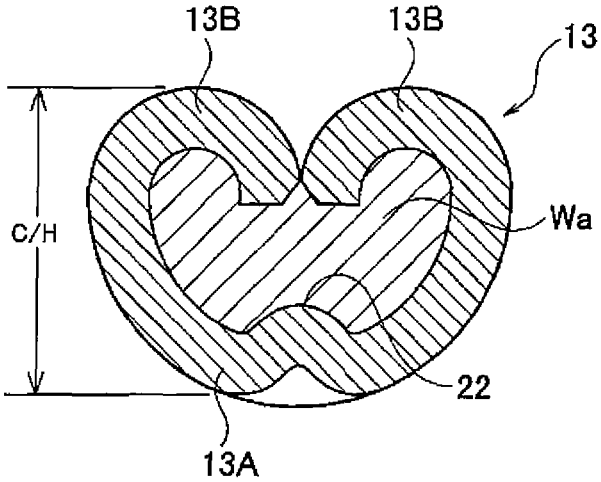
Figure 2A:
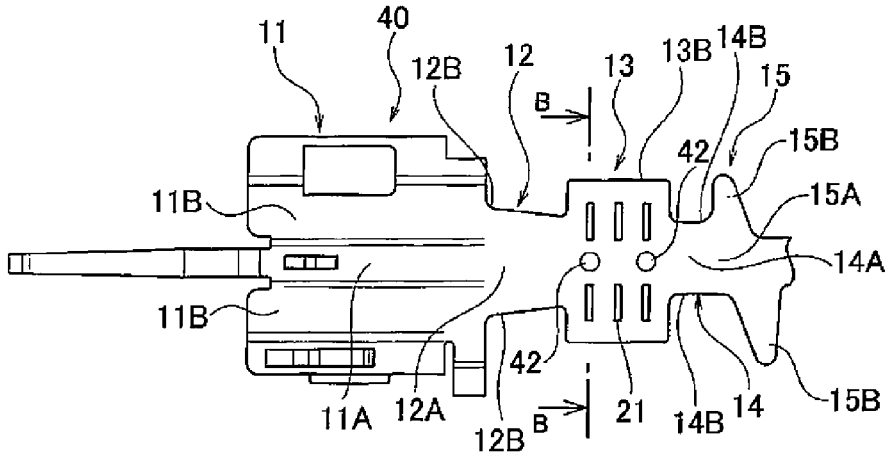
FIGS. 2(*a*) to 2(*e*) are configuration views of a press bond terminal of a second embodiment of the invention, and FIG. 2(*a*) is a developed plan view of the press bond terminal, and FIG. 2(*b*) is a sectional view taken on arrow line B-B of FIG. 2(*a*), and FIG. 2(*c*) is a transverse sectional view showing a state after a conductor press bond part of the press bond terminal is pressed and bonded, and FIG. 2(*d*) is a partially perspective view showing a state after the conductor press bond part is pressed and bonded, and FIG. 2(*e*) is a sectional view taken on arrow line C-C of FIG. 2(*d*).
Figure 2B:
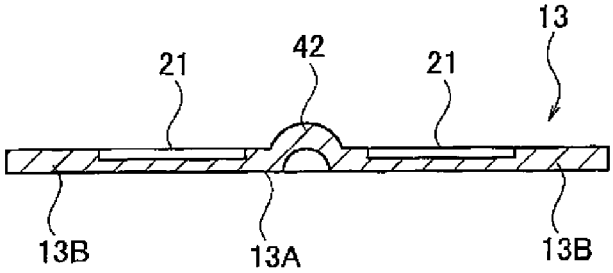
Figure 2C:
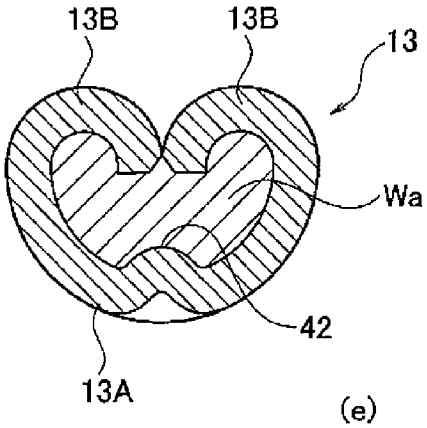
Figure 2D:
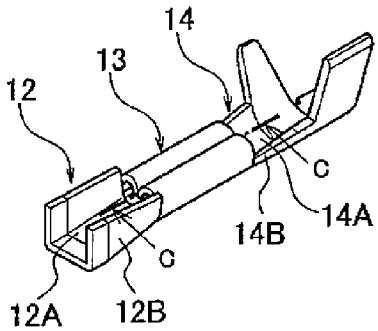
Figure 2D:
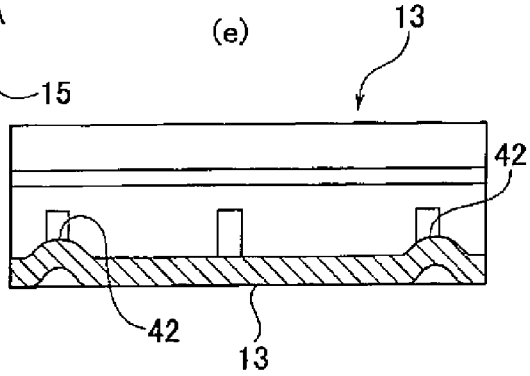
Figure 3:
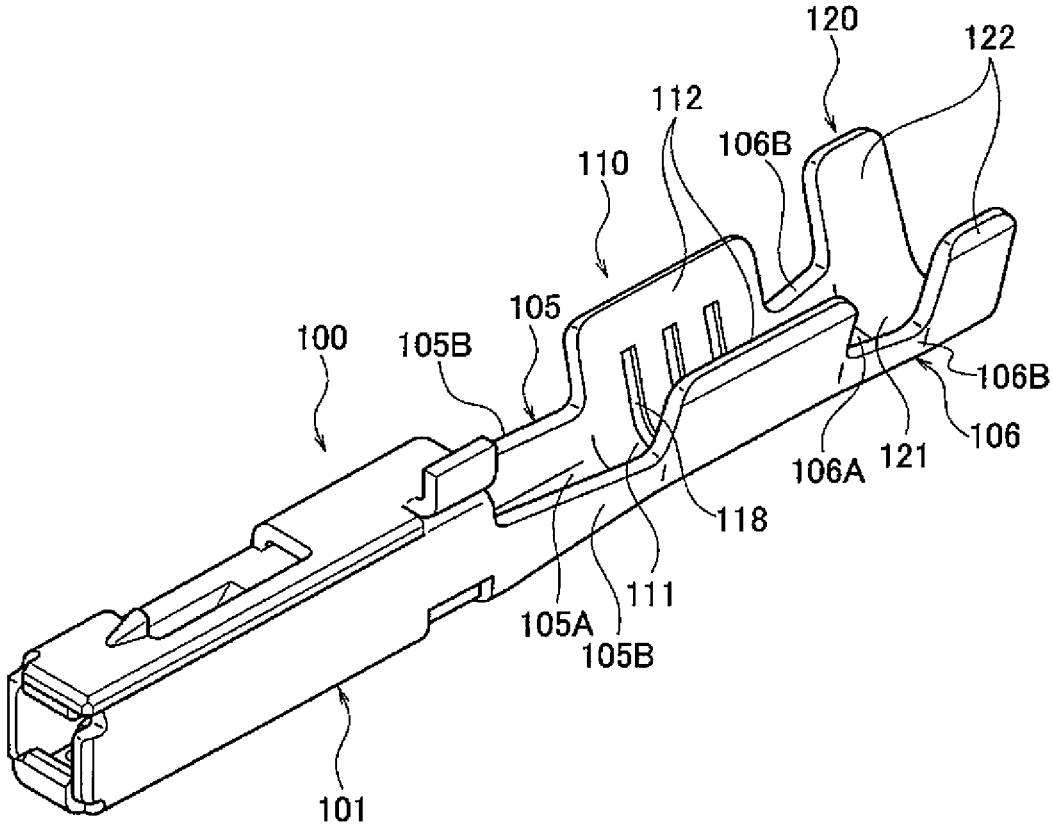
FIG. 3 RELATED ART
FIG. 3 is a perspective view showing a configuration of a conventional press bond terminal.

FIGS. 1(*a*) to 1(*c*) are configuration views of a press bond terminal of a first embodiment, and FIG. 1(*a*) is a developed plan view of the press bond terminal, and FIG. 1(*b*) is a sectional view taken on arrow line A-A of FIG. 1(*a*), and FIG. 1(*c*) is a transverse sectional view showing a state after a conductor press bond part of the press bond terminal is pressed and bonded.

This press bond terminal 10 includes an electrical connection part 11 connected to a terminal of the other connector side (not shown) in the front of a longitudinal direction (also a longitudinal direction of a conductor of an electric wire connected) of the terminal, and includes a conductor press bond part 13 crimped to the conductor in which the distal end of the electric wire (not shown) is exposed in the back of the electrical connection part 11, and further includes a coating crimp part 15 crimped to the portion having an insulating coating in the electric wire in the back of the conductor press bond part 13. Also, a first joining part 12 for joining the electrical connection part 11 to the conductor press bond part 13 is included between the electrical connection part 11 and the conductor press bond part 13, and a second joining part 14 for joining the conductor press bond part 13 to the coating crimp part 15 is included between the conductor press bond part 13 and the coating crimp part 15.

The conductor press bond part 13 is formed in substantially a U-shaped cross section by a base plate 13A and a pair of conductor crimp pieces 13B, 13B which is extended upward from both right and left lateral edges of the base plate 13A and is crimped so as to wrap the conductor of the electric wire disposed on an inner surface of the base plate 13A.

Also, the coating crimp part 15 is formed in substantially a U-shaped cross section by a base plate 15A and a pair of coating crimp pieces 15B, 15B which is extended upward from both right and left lateral edges of the base plate 15A and is crimped so as to wrap the electric wire (that is, the portion having the insulating coating) disposed on an inner surface of the base plate 15A.

Also, both of the first joining part 12 and the second joining part 14 in the front and back of the conductor press bond part 13 are formed in substantially U-shaped cross sections by base plates 12A, 14A and low side plates 12B, 14B upward erected from both right and left lateral edges of the base plates 12A, 14A.

Then, the base plates ranging from the front electrical connection part 11 to the backmost coating crimp part 15, that is, a base plate 11A of the electrical connection part 11, the base plate 12A of the first joining part 12, the base plate 13A of the conductor press bond part 13, the base plate 14A of the second joining part 14 and the base plate 15A of the coating crimp part 15 are formed continuously in a shape of one band plate. Also, the front and back ends of the low side plate 12B of the first joining part 12 respectively continue with the back end of a side plate 11B of the electrical connection part 11 and each lower half part of the front end of the conductor crimp piece 13B of the conductor press bond part 13, and the front and back ends of the low side plate 14B of the second joining part 14 respectively continue with the back end of the conductor crimp piece 13B of the conductor press bond part 13 and each lower half part of the front end of the coating crimp piece 15B of the coating crimp part 15.

Also, in this press bond terminal 10, the widthwise center of an inner surface of the base plate 13A of the conductor press bond part 13 is provided with a projecting bar (projection) 22 formed by being pushed from an outer surface. This projecting bar 22 is formed continuously in the front and back directions over the whole region of making close contact with a conductor Wa of an electric wire at the time of press bonding. Also, an inner surface of the conductor press bond part 13 is provided with plural (three in the present example) serrations 21 with a recessed groove shape extending in a direction orthogonal to the longitudinal direction (that is, the longitudinal direction of the terminal) of the conductor of the electric wire. Since the projecting bar 22 is present in the widthwise center of the base plate 13A, the serrations 21 in this case are divided into the right and left portions and are formed so as not to interfere with the projecting bar 22.

In the case of pressing and bonding the conductor press bond part 13 of this press bond terminal 10 to the conductor Wa of the distal end of the electric wire, the press bond terminal 10 is placed on a placement surface (an upper surface) of a lower mold (an anvil) (not shown) and also, the conductor of the distal end of the electric wire is inserted between a pair of conductor crimp pieces 13B, 13B of the conductor press bond part 13 and is placed on an upper surface of the base plate 13A. Then, by downward moving an upper mold (a crimper) relatively with respect to the lower mold, the distal end sides of the conductor crimp pieces 13B, 13B are gradually laid inward by a guide inclined surface of the upper mold. Then, by further downward moving the upper mold (the crimper) relatively with respect to the lower mold, finally, as shown in FIG. 1(*c*), the distal ends of the conductor crimp pieces 13B, 13B are rounded so as to be folded back to the side of the conductor Wa by a curved surface ranging from the guide inclined surface of the upper mold to a chevron-shaped part of the center, and the distal ends of the conductor crimp pieces 13B, 13B are mutually bitten into the conductor Wa while being rubbed together and thereby, the conductor crimp pieces 13B, 13B are crimped so as to wrap the conductor Wa. By the above operation, the conductor press bond part 13 of the press bond terminal 10 can be connected to the conductor Wa of the electric wire by press bonding. Similarly in the coating crimp part 15, using the lower mold and the upper mold, the coating crimp pieces 15B, 15B are gradually bent inward and are crimped to the portion having the insulating coating in the electric wire. This allows the press bond terminal 10 to be electrically and mechanically connected to the electric wire.

The press bond terminal 10 of the embodiment can have the following effects in a state of making connection by press bonding thus.

That is, the presence of the projecting bar 22 projecting to the side of the conductor Wa of the electric wire in the conductor press bond part 13 can increase internal stress of the conductor press bond part 13 as compared with a press bond part with the same crimp height (C/H) having no projecting bar 22. As a result, a grip force of the conductor press bond part 13 on the conductor Wa of the electric wire can be improved, and misalignment between core wires of the conductor Wa can be reduced and the range of compatibility between stable electrical contact and fastening strength can be expanded. Also, the presence of the projecting bar 22 can increase rigidity of the conductor press bond part 13.

Second Embodiment

FIGS. 2(*a*) to 2(*e*) are configuration views of a press bond terminal of a second embodiment, and FIG. 2(*a*) is a developed plan view of the press bond terminal, and FIG. 2(*b*) is a sectional view taken on arrow line B-B of FIG. 2(*a*), and FIG. 2(*c*) is a transverse sectional view showing a state after a conductor press bond part of the press bond terminal is pressed and bonded, and FIG. 2(*d*) is a partially perspective view showing a state after the conductor press bond part is pressed and bonded, and FIG. 2(*e*) is a sectional view taken on arrow line C-C of FIG. 2(*d*).

This press bond terminal 40 of the second embodiment differs from the press bond terminal 10 of the first embodiment in that instead of the continuous projecting bar 22, the widthwise center of an inner surface of a base plate 13A of a conductor press bond part 13 is provided with plural projections 42 spaced in the front and back directions. Since the others are similar to the first embodiment, explanation is omitted by assigning the same numerals to the same portions.

The projections 42 in this case could be formed in both ends of the range of having the possibility of making contact with a conductor Wa, and in the present embodiment, the projections 42 are arranged in positions of serrations 21 of both ends (that is, both ends of the three serrations) in the front and back directions.

As shown in FIGS. 2(*c*) to 2(*e*), the projections 42 formed thus can increase internal stress of the conductor press bond part 13 as compared with a press bond part with the same crimp height (C/H) having no projections 42. Also, in conjunction with an increase in the internal stress, an increase in a binding force of the conductor Wa in a region sandwiched between the front and back projections 42 strengthens action of reducing misalignment (particularly, the front and back directions) between core wires of the conductor Wa, and a more stable contact state can be maintained. As a result, a grip force of the conductor press bond part 13 on the conductor Wa of the electric wire can be improved, and the misalignment between core wires of the conductor Wa can be reduced and the range of compatibility between stable electrical contact and fastening strength can be expanded. Also, the presence of the projections 42 can increase rigidity of the conductor press bond part 13.

In addition, the number of projections 42 can be set arbitrarily.

Also, the projecting bar 22 or the projections 42 may extend to base plates 12A, 14A of joining parts 12, 14.

The present application is based on Japanese patent application (patent application No. 2009-247868) filed on Oct. 28, 2009, and the contents of the patent application are hereby incorporated by reference.

DESCRIPTION OF REFERENCE NUMERALS AND SIGNS

10,40 PRESS BOND TERMINAL
11 ELECTRICAL CONNECTION PART
13 CONDUCTOR PRESS BOND PART
13A BASE PLATE

13B CONDUCTOR CRIMP PIECE
22 PROJECTING BAR (PROJECTION)
42 PROJECTION

The invention claimed is:

1. A press bond terminal comprising:

a conductor press bond part connected by being pressed and bonded to a distal end of a conductor of an electric wire, the conductor press bond part being formed in substantially a U-shaped cross section by a base plate and a pair of conductor crimp pieces which is extended upward from both right and left lateral edges of the base plate and is crimped so as to wrap the conductor disposed on an inner surface of the base plate, wherein an inner surface of the base plate of the conductor press bond part is provided with a projection; and plural serrations located on the press bond part, wherein the plural serrations do not contact the projection, and the projection is formed in a longitudinal direction of the conductor.

2. The press bond terminal according to claim 1, wherein the projection is preferably formed as a projecting bar continuous in the longitudinal direction of the conductor.

3. The press bond terminal according to claim 1, wherein the projection is preferably formed as plural projections.

4. The press bond terminal according to claim 1, wherein the plural serrations are located on an inner surface of the conductor press bond part.

5. The press bond terminal of claim 1, wherein the plural serrations are located on either side of and perpendicular to the projection on the press bond part.

* * * * *